United States Patent [19]

Yamamoto

[11] 3,991,982

[45] Nov. 16, 1976

[54] BALUSTRADE WITH MEANS FOR CONNECTION OF BALUSTERS TO A RAIL

[75] Inventor: Yukio Yamamoto, Kurobe, Japan

[73] Assignee: Yoshida Kogyo Kabushiki Kaisha, Japan

[22] Filed: Sept. 9, 1974

[21] Appl. No.: 504,352

[30] Foreign Application Priority Data

Sept. 14, 1973 Japan ..... 48-107928[U]

[52] U.S. Cl. ..... 256/65

[51] Int. Cl.[2] ..... E04H 17/14

[58] Field of Search ..... 52/758 A, 758 R, 666, 52/669; 463/242, 284, 274; 256/21, 22, 24, 59, 65, 47; 29/521

[56] References Cited

UNITED STATES PATENTS

| | | | |
|---|---|---|---|
| 1,888,954 | 11/1932 | Keil | 29/510 |
| 2,590,929 | 4/1952 | Bush | 256/21 |
| 2,815,937 | 12/1957 | Curtze | 256/23 |

*Primary Examiner*—Thomas F. Callaghan
*Assistant Examiner*—Doris L. Troutman
*Attorney, Agent, or Firm*—Buckman and Archer

[57] ABSTRACT

For connection of a series of balusters to a top rail, each baluster is provided with a pair of jaws extending upwardly from its top end. The top rail has an integral retainer ridge formed lengthwise on its bottom surface. The retainer ridge includes a pair of shoulders having transversely registered pairs of recesses at prescribed longitudinal spacings. A pair of grooves are formed lengthwise in the respective lateral surfaces of the retainer ridge, and another pair of grooves are formed lengthwise in the bottom surface of the top rail on both sides of the retainer ridge. The jaws of each baluster are inserted into the respective grooves in the bottom surface of the top rail via the respective recesses, and the mid-portions of the jaws are then caused to project into the respective grooves in the lateral surfaces of the retainer ridge by pressing operation. The balusters can likewise be connected to a bottom rail.

5 Claims, 6 Drawing Figures

BALUSTRADE WITH MEANS FOR CONNECTION OF BALUSTERS TO A RAIL

BACKGROUND OF THE INVENTION

This invention relates to balustrades, and more specifically to a balustrade having means for easy and positive connection of a series of balusters to a top or bottom rail.

Various means have been proposed and used for connection of balusters to a rail. According to an example of such known means, a pair of opposed connectors project outwardly from each of a series of apertures formed in a rail. These connectors are inserted into each hollow baluster, and a wedge is then driven in between the connectors for rigidly joining the baluster to the rail. This method is disadvantageous in view of the difficulties involved in the production of the rail with its connectors and in the assemblage of the complete balustrade. Moreover, since the balusters are subject to internal pressure from the driven-in wedges, cracks or fissures tend to be produced therein after extended periods of use.

Another method is known in which an end portion of each hollow baluster is cut off, and the opposed ends of the remaining baluster proper and the severed end portion are held in abutment against the marginal edge portion of an aperture formed in the top surface of a bottom rail from both sides thereof. A headed pin is succeedingly driven into the severed baluster end portion, the aperture and the baluster proper. This method also has a drawback in connection with the extra time and trouble required for cutting off the end portion of each baluster. The possible formation of cracks or fissures in the balusters with the lapse of time is a problem in common with the precedingly described method.

According to still another example of the prior art means, a hollow, metal-made cylinder is fitted over one end of each baluster, and this cylinder is inserted into and through an aperture formed in the top surface of a bottom rail. Pressure is then applied to the cylinder from its both ends to form bellows like pleats therein, thereby causing the same to clamp the top surface of the bottom rail and also to tightly embrace the end portion of the baluster that has been fitted therein. However, the application of pressure to the cylinder from the opposite sides of the bottom rail, in a manner well calculated to produce the anticipated results, is a highly troublesome operation that requires a rather complex mechanism. It is also a disadvantage of this known method that the balusters cannot necessarily be connected to the rail with a required degree of firmness.

SUMMARY OF THE INVENTION

It is a principal object of this invention to provide a balustrade having improved means for easy and positive connection of a series of balusters to a rail, such that the listed disadvantages of the prior art are overcome in a highly efficient and practical manner.

The concepts of this invention are equally applicable to a balustrade having a top rail only and to one having both top and bottom rails. In the former case, each of the balusters to be connected to the top rail is provided with a pair of jaws extending upwardly from its top end. A retainer ridge formed longitudinally on the lower surface of the top rail is formed with a plurality of transversely registered pairs of recesses at predetermined longitudinal spacings which are adapted to engage the basal end portions of the respective jaws of the balusters. A first pair of grooves are formed longitudinally in both lateral surfaces of the retainer ridge to engage the inwardly projecting mid-portions of the jaws, and a second pair of grooves are formed longitudinally in the lower surface of the top rail on both sides of the retainer ridge to engage the tips of the jaws.

For the assemblage of the balustrade, the jaws of each baluster may be inserted into and through each transversely registered pair of recesses until their tips are fully received in the second pair of grooves, respectively. The jaws are then pressed against the respective lateral surfaces of the retainer ridge so that the mid-portions of the jaws will project into the first pair of grooves, respectively. By this simple procedure, each baluster can be connected to the rail in a manner precluding the possibility of detachment or displacement in any possible direction.

The features which are believed to be novel and characteristic of this invention are set forth with particularity in the appended claims. The invention itself, however, as well as the further objects and advantages thereof, will be best understood from the following description taken in conjunction with the accompanying drawings wherein like reference characters denote corresponding parts of the several views.

DESCRIPTION OF THE PREFERRED EMBODIMENTS

Figure 1:
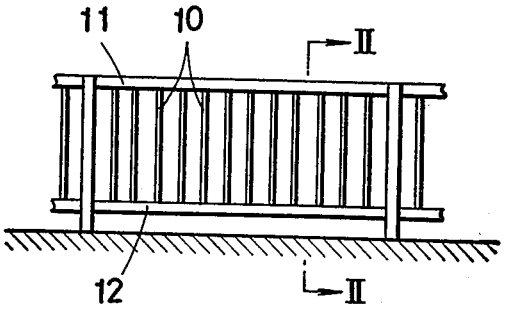
FIG. 1 is a side elevational view of a balustrade representing one of the specific adaptations of this invention.
Figure 2:
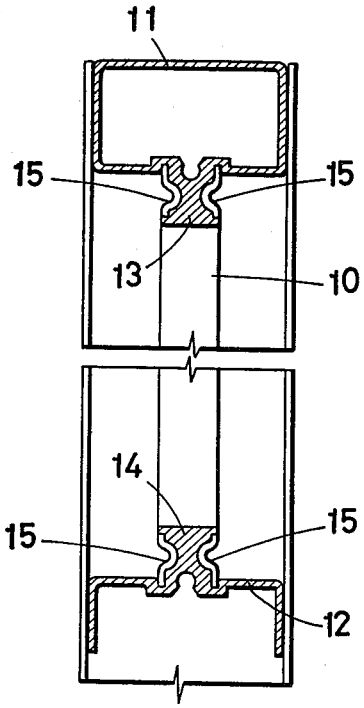
FIG. 2 is an enlarged sectional view taken along the plane of line II — II in FIG. 1.

The invention will now be described more specifically as adapted by way of example for a balustrade which, as illustrated in FIGS. 1 and 2, comprises a series of balusters 10, a top rail 11 and a bottom rail 12. All these constituent members of the balustrade can be made of structural metal. The top and bottom rails 11 and 12 are integrally provided with a pair of longitudinal retainer ridges 13 and 14, respectively, that project inwardly from their opposed inside surfaces in vertical alignment. These retainer ridges 13 and 14 are adapted, in a manner hereinafter set forth, to permit the easy and positive installation of the balusters 10 between the top and bottom rails 11 and 12.

Figure 3:
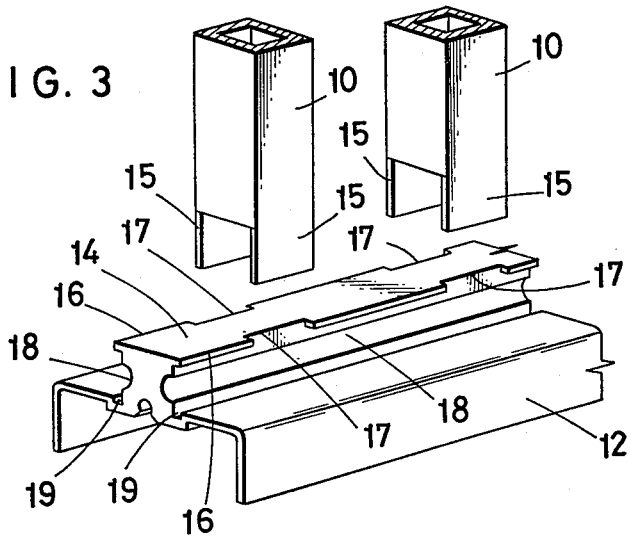
FIG. 3 is a partial perspective view showing the balusters and the bottom rail of FIGS. 1 and 2 prior to their connection.
Figure 4:
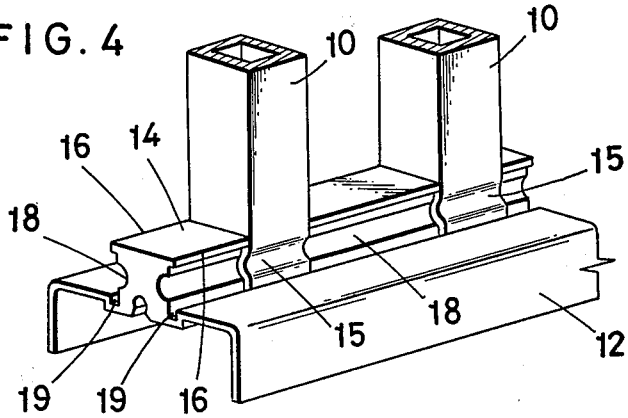
FIG. 4 is a view similar to FIG. 3 but showing the balusters and the bottom rail connected together.

As illustrated in greater detail in FIGS. 3 and 4, each of the balusters 10 is rectangular in cross-sectional shape and has a pair of jaws 15 at each end that are formed by extensions from its opposed side walls. Each of the retainer ridges 13 and 14 on the top and bottom rails 11 and 12 has a pair of shoulders 16 projecting laterally from its end remote from the top or bottom rail, and these shoulders 16 have transversely registered pairs of recesses 17 at predetermined longitudinal spacings for receiving the jaws 15 of the respective balusters 10. Each of the retainer ridges 13 and 14 is further formed with a first pair of longitudinal grooves 18 of substantially semicircular cross section in both lateral surfaces thereof. A second pair of longitudinal grooves 19, with a width sufficient to neatly receive the tips of the respective jaws 15 of each baluster, are formed in each of the top and bottom rails 11 and 12 on both sides of the retainer ridge 13 or 14 along the basal end thereof.

Figure 5:
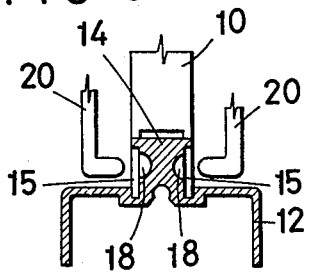
FIG. 5 is a partial vertical sectional view showing one of the balusters and the bottom rail before the jaws of the former are pressed against the retainer ridge of the latter.

For the assemblage of the balustrade constructed as hereinbefore described, the downwardly extending jaws 15 of each baluster 10 may first be fitted in each pair of recesses 17 of the retainer ridge 14 on the bottom rail 12 until the tips of the jaws are fully received in the respective grooves 19 formed in the inside surface of the bottom rail, as illustrated in FIG. 5. The midportions of the downwardly extending jaws 15 of each baluster are then caused to project into the respective grooves 18 of the retainer ridge 14 by means of a suitable pressing tool 20, with the result that the jaws are bent in the exact contour of the grooves 18, as clearly seen in FIG. 6. It will be apparent that the upwardly extending jaws 15 of each baluster can likewise be connected to the retainer ridge 13 of the top rail 11.

Figure 6:
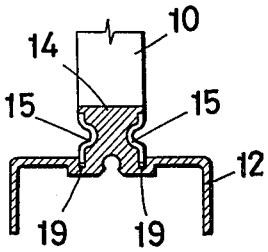
FIG. 6 is a view similar to FIG. 5 but showing the jaws of the baluster pressed against the retainer ridge of the bottom rail.

With the assemblage of the balustrade thus completed easily according to the concepts of this invention, it will be observed that each baluster 10 is prevented from detachment or displacement in its longitudinal direction by the grooves 18 engaging the bent mid-portions of the jaws 15 thereof, from detachment or displacement in the longitudinal direction of the retainer ridge 13 or 14 by the recesses 17 engaging the basal end portions of the jaws, and from detachment or displacement in the lateral direction of the retainer ridge by the grooves 19 engaging the tips of the jaws. Preferably, the tips of the jaws 15 of each baluster should be completely buried in the respective grooves 19 after the jaws have been pressed against the lateral surfaces of the retainer ridge 13 or 14, although some open spaces left in the grooves 19 as shown in FIG. 6 can be a cause of no serious trouble or inconvenience.

It may be worth mentioning that the grooves 19 are also effective to prevent the tips of the jaws 15 of each baluster 10 from expanding or turning away from each other while the jaws are being pressed into the respective grooves 18. The retainer ridges 13 and 14 can be easily formed integral with the respective rails 11 and 12 as by extrusion molding, and the balusters 10 are also extremely easy to mold, so that the manufacture of the complete balustrade will be effected highly expeditiously.

Although the balustrade according to the invention has been shown and described hereinbefore in very specific aspects thereof, it is to be clearly understood that the invention itself is not to be restricted by the exact showing of the drawings or the description thereof. For example, the concepts of this invention are easily applicable to balustrades having no bottom rail, as previously mentioned. It is therefore appropriate that the invention be construed broadly and in a manner consistent with the fair meaning or proper scope of the following claims.

What is claimed is:

1. In a balustrade including at least a series of balusters and a top rail, the combination therewith of a pair of jaws extending upwardly from one end of each of said balusters, and a retainer ridge formed longitudinally on the lower surface of said top rail for connection of said balusters to the latter, said retainer ridge including a plurality of transversely registered pairs of recesses formed therein at predetermined longitudinal spacings engaging the basal end portions of the respective jaws of said balusters, a first pair of grooves formed longitudinally in both lateral surfaces of said retainer ridge engaging the mid-portions of the respective jaws of said balusters which project inwardly, and a second pair of grooves formed longitudinally in the lower surface of said top rail on both sides of said retainer ridge engaging the tips of the respective jaws of said balusters.

2. The balustrade as recited in claim 1, wherein said recesses are formed in a pair of shoulders projecting laterally from the end of said retainer ridge remote from said top rail.

3. The balustrade as recited in claim 1, wherein said mid-portions of said jaws of said balusters are caused to project into said first pair of grooves by pressing operation after the tips of said jaws have been engaged by said second pair of grooves and the jaws are bent to the contour of said grooves.

4. The balustrade as recited in claim 3, wherein said first pair of grooves are each of substantially semicircular cross section.

5. The balustrade as recited in claim 1, further including a bottom rail adapted to be connected to the other ends of said balusters in the same way as said top rail.

* * * * *